US010750879B2

(12) United States Patent
Schachtner

(10) Patent No.: US 10,750,879 B2
(45) Date of Patent: Aug. 25, 2020

(54) CARRYING DEVICE

(75) Inventor: Petra Schachtner, Marburg (DE)

(73) Assignee: SCHACHTNER VERMOEGENSVERWALTUNGS GMBH & CO. KG, Marburg-Shroeck (DE)

( * ) Notice: Subject to any disclaimer, the term of this patent is extended or adjusted under 35 U.S.C. 154(b) by 1167 days.

(21) Appl. No.: 12/597,756

(22) PCT Filed: Apr. 22, 2008

(86) PCT No.: PCT/EP2008/003209

§ 371 (c)(1),
(2), (4) Date: Feb. 23, 2010

(87) PCT Pub. No.: WO2008/135156

PCT Pub. Date: Nov. 13, 2008

(65) Prior Publication Data

US 2010/0147910 A1 Jun. 17, 2010

(30) Foreign Application Priority Data

Apr. 27, 2007 (DE) ..... 20 2007 006 204 U

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/00; A47D 13/02; A45C 7/00
USPC ..... 224/158, 159, 160, 161; D3/213, 214
See application file for complete search history.

(56) References Cited

U.S. PATENT DOCUMENTS 3,481,517 A * 12/1969 Aukerman ..... 224/160
4,009,808 A * 3/1977 Sharp ..... A47D 13/025 224/160
4,402,440 A * 9/1983 Purtzer ..... A47D 13/025 224/159
4,428,514 A * 1/1984 Elf ..... A47D 13/025 224/155
4,434,920 A * 3/1984 Moore ..... 224/160
(Continued)

FOREIGN PATENT DOCUMENTS

DE 86 15 859.7 U1 9/1986
DE 39 16 370 11/1990
(Continued)

*Primary Examiner* — Adam J Waggenspack
(74) *Attorney, Agent, or Firm* — Clark & Brody LP

(57) ABSTRACT

The invention relates to a carrying device (10) with an accommodation body (12) for accommodating a baby or a small child. The accommodation body (12) is constructed in such a way that the height thereof is adjustable and such that at least one region of the back of a baby or a small child can be accommodated and/or supported therein, thereby preventing the sinking or sagging of the newborn. Because the carrying device (10) has a holding harness system (40, 60) for fastening the accommodation body (12) to a person, and because the height of the accommodation body (12) is adjustable, sufficient support for the back of the small child from birth up to the age of young child is ensured, as well as an orthopedically correct carrying manner for both the young child and the wearer.

14 Claims, 7 Drawing Sheets

(56) References Cited

U.S. PATENT DOCUMENTS

| | | | | |
|---|---|---|---|---|
| 4,606,078 | A * | 8/1986 | Tkacsik | A41D 1/20 2/102 |
| 4,986,458 | A * | 1/1991 | Linday | 224/160 |
| 5,020,709 | A * | 6/1991 | Hoaglan | 224/155 |
| 5,205,450 | A | 4/1993 | Derosier | |
| 5,246,152 | A * | 9/1993 | Dotseth | A47D 13/025 224/158 |
| 5,341,514 | A * | 8/1994 | Dale | 2/96 |
| 5,848,741 | A * | 12/1998 | Fair | 224/160 |
| 5,934,528 | A * | 8/1999 | Higuchi | 224/159 |
| 6,058,508 | A * | 5/2000 | Brown Honeysuckle | 2/69 |
| 6,443,339 | B1 * | 9/2002 | Higuchi | 224/160 |
| 6,988,644 | B1 * | 1/2006 | Asherbranner | 224/160 |
| 2001/0030210 | A1 * | 10/2001 | Donine | 224/160 |
| 2003/0178452 | A1 * | 9/2003 | Norman | 224/160 |
| 2005/0189386 | A1 * | 9/2005 | Mortell | 224/160 |
| 2006/0011678 | A1 * | 1/2006 | Kassai et al. | 224/160 |
| 2007/0246493 | A1 * | 10/2007 | Kernkamp | 224/159 |
| 2008/0190972 | A1 * | 8/2008 | Gray | 224/160 |
| 2009/0206116 | A1 * | 8/2009 | Grant | A45F 3/08 224/160 |
| 2012/0234877 | A1 * | 9/2012 | Hiniduma-Lokuge | A47D 13/025 224/159 |
| 2014/0097215 | A1 * | 4/2014 | Caperon | A47D 13/025 224/160 |

FOREIGN PATENT DOCUMENTS

| | | | | |
|---|---|---|---|---|
| DE | 297 01 891 | U1 | | 3/1997 |
| DE | 102 28 987 | C1 | | 9/2003 |
| DE | 698 23 899 | T2 | | 5/2005 |
| EP | 1 616 510 | A1 | | 1/2006 |
| EP | 1 680 989 | A1 | | 7/2006 |
| FR | 2546389 | | * | 5/1983 |
| JP | 2-40249 | | | 3/1990 |
| JP | 2001-104115 | | | 4/2001 |
| WO | 97/16096 | A1 | | 5/1997 |
| WO | 2005/025383 | | | 3/2005 |

* cited by examiner

CARRYING DEVICE

The present invention relates to a carrying device according to claim 1.

A carrying device of this type is known, for example, from WO 2005/025383 A2. It comprises a receiving body with an upper edge, a lower edge and two opposite side edges. In addition, the carrying device has a carrying harness system with a hip strap, two shoulder straps and a chest strap. The hip strap is suitable for surrounding the wearer's hips. It has an upper edge which is connected to the lower edge of the receiving body in such a manner that the receiving body is centered substantially centrally above the hip strap. An upper end of each shoulder strap is connected to an upper corner of the receiving body, and a lower end of each shoulder strap is connected to the receiving body below the upper end of the shoulder strap in such a manner that each shoulder strap forms a loop. The chest strap is connected slidably at each of the ends thereof to the shoulder straps. Furthermore, the carrying device has a head part which comprises an upper edge, a lower edge and two opposite side edges, the lower edge of the head part being fastened to the upper edge of the receiving body in such a manner that the head part is centered substantially above the receiving body. In addition, fastening elements designed in the manner of loops are fastened to each upper corner of the head part, the fastening elements being held on the chest strap with the aid of releasable connecting elements.

Such a construction creates a carrying device in which a baby or a small child can be held between the receiving body and either the wearer's back or chest, wherein the contact pressure force required for this purpose is produced by the shoulder straps, the hip strap and the chest strap being closed and appropriately adjusted. However, a substantial disadvantage of this carrying device is that it cannot be adapted to the height of the baby or child to be received in the carrying device. For example, newborn babies may sink or sag in the receiving body while the back area of larger small children is already no longer sufficiently supported.

It is therefore the aim of the invention to overcome this and other disadvantages of the prior art and to create a carrying device of the type mentioned at the beginning which is suitable for receiving small children from birth up to the age of small children, wherein an orthopedically correct manner of support both for the small child and for the wearer is to be ensured. The carrying device is furthermore to be constructed in a simple and cost-effective manner and to be simple to handle. Furthermore, increased safety both for the child to be received and for the male or female wearer of the device is sought.

The present invention creates a carrying device with a receiving system for receiving a baby or small child, wherein the receiving system has a receiving body designed in such a manner that at least one area of the rear side of a child can be received and/or can be supported therein, and with a carrying harness system for fastening the receiving system to a person. According to the invention, the receiving body is designed in such a manner that the height thereof can be changed.

This height adjustability enables the receiving body always to be optimally adapted to the height of the baby or small child to be received in the carrying device such that babies even from birth up to the age of small children, i.e. up to, for example, approximately 20 kg, can be carried in the carrying device.

At least sections of the receiving body, preferably involve a receiving body which is in the manner of a cloth or pad and is suitable for adapting to the body shape of that area of the rear side of the baby or of the small child which is received in the receiving body and which is supported by the latter.

In order to realize the height adjustability of the receiving body, the carrying device preferably has at least one extension element which can be positioned on the receiving body in such a manner that the receiving body is extended in the vertical direction by the extension element. The extension element is advantageously likewise designed in the manner of a cloth and/or pad in order even in the case of said extension element to ensure adaptability to the body of the small child.

According to a refinement of the present invention, the extension element can be fastened releasably to the receiving body. If a taller small child is to be carried in the carrying device, the extension element is positioned on the receiving body in order to extend the latter. If, by contrast, the small child is still very small, consequently if therefore a baby, the extension element is simply not used or is pulled in or folded up.

According to an alternative refinement of the present invention, the extension element is designed as a single part with the receiving body, wherein said extension element can be adjusted between at least two positions, specifically a first position, in which the height of the receiving body is not increased by said extension element, and a second position, in which the height of the receiving body is increased by the extension element. In this case, the extension element can preferably be folded from the first position into the second position, and vice versa. As an alternative, the extension element can be rolled up or unrolled from the first position into the second position, or vice versa.

A fastening device is advantageously provided in order to fix the extension element in the first position thereof. The fastening device can have, for example, a zipper and/or snap fasteners and/or touch and close fasteners. In the case of touch and close fasteners which comprise barb surfaces and loop surfaces, the carrying device preferably has covering means with which touch and close fastener regions, in particular the barb surfaces, can be covered. The covering means prevent contact of the child with annoying touch and close fastener regions, thus making it more comfortable for the child to sit in the receiving body.

In order to be able to adapt the shape of the receiving body of the carrying device even better to the height of the baby or small child to be received in the carrying device and in order to increase both the safety and the carrying comfort, the carrying device advantageously comprises a seat reduction device. The latter can preferably be positioned on the receiving body in such a manner that a baby or a small child is received higher and therefore in an elevated position in the receiving body.

In a similar manner to the receiving body and the extension element, at least sections of the seat reduction device are also designed in the manner of a cloth and/or pad such that said seat reduction device can be flexibly adapted to the body shape of the area of the small child to be received by it.

According to a refinement of the present invention, the seat reduction device can be fastened releasably to the receiving body and can be positioned on the receiving body or not used, depending on requirements.

According to another refinement of the present invention, the seat reduction device is designed as a single part with the receiving body, wherein it can be adjusted between at least two positions, specifically a first position, in which it reduces the height of the seat of the small child in the receiving body, and a second position, in which it does not reduce the height of the seat of the small child in the receiving body. In the latter case, the seat reduction device is preferably designed such that it can be folded in such a manner that it can be stowed in the second position thereof such that it does not impair the operation of the carrying device. In order to fold the seat reduction device, the latter preferably has predetermined folding lines, for example in the form of color-contrasted seams or the like which assist a person in the folding of said seat reduction device. In order to stow the seat reduction device, the receiving body advantageously has a pocket which preferably comprises closure elements for closing of same.

The carrying harness system of the carrying device according to the invention preferably has a shoulder strap device with shoulder straps. The shoulder strap device advantageously comprises at least one adjustment device for changing the shoulder strap length such that the shoulder strap device can be adapted to the body build and the height of the wearer. In order to pad the shoulders, the shoulder strap device furthermore preferably has shoulder pad sections, wherein the shoulder strap device advantageously has at least one adjustment device for changing the effective position of the shoulder pad sections, thus permitting comfortable wearing of the carrying device for the wearer.

The shoulder straps preferably have closure elements for opening and closing the shoulder straps, wherein the closure elements are advantageously secured by a securing device preventing immediate release of the shoulder straps after the opening of a closure element. It can thereby be ensured that, after the release of the closure elements on the shoulder straps, a child held in the carrying device will not immediately drop out of the carrying device. The securing device can be designed, for example, in the manner of a loop, specifically such that, after the release of the closure elements of the shoulder straps, said closure elements remain attached to the securing device which is designed in the manner of a loop. Although the shoulder straps are then already released from the lateral clips on the receiving body, the child held by the carrying device can still not drop out.

Furthermore, the carrying harness system of the carrying device according to the invention preferably comprises a hip strap device with a hip strap. The hip strap device advantageously comprises at least one closure element for opening and closing of same, wherein the at least one closure element is likewise advantageously secured by a securing device of the type described previously, which prevents immediate release or opening of the hip strap after the opening of the closure element.

In addition, the carrying harness system of the carrying device according to the invention advantageously comprises a chest strap device with a chest strap which is preferably fastened to the shoulder device.

By means of a carrying harness system with a shoulder strap device, a hip strap device and a chest strap device, both the safety and wearing comfort of the carrying device according to the invention are optimized.

Furthermore, the carrying device according to the present invention preferably comprises a head part which supports the head and/or back of the neck of the child received in the carrying device and/or serves as a sunshade. The head part is also preferably designed in the manner of a cloth and/or pad and is connected releasably or fixedly to the receiving body. The head part advantageously has fastening elements which can be positioned on the carrying harness system in order to position the head part in a predetermined manner, wherein the fastening elements are preferably designed in such a manner that they can tension or tighten up the head part. This can be realized, for example, by elastic bands or the like being used as the fastening elements. In addition, receiving elements for receiving the fastening elements are advantageously arranged on the carrying harness system, in particular on the shoulder straps.

Said receiving elements are preferably formed and positioned movably on the shoulder straps in order to be able to arrange and, if appropriate, tension the head part in different positions, wherein the receiving elements are designed in such a manner that they can optionally be fixed at a selected position on the carrying harness system or on the shoulder strap such that they cannot be moved further. Accordingly, the head element can be fixed in different positions to meet requirements.

Further features, details and advantages of the invention emerge from the wording of the claims and from the description below of exemplary embodiments with reference to the drawings, in which:

The same reference numbers refer below to components which are identical or are of the same kind.

Figure 1:
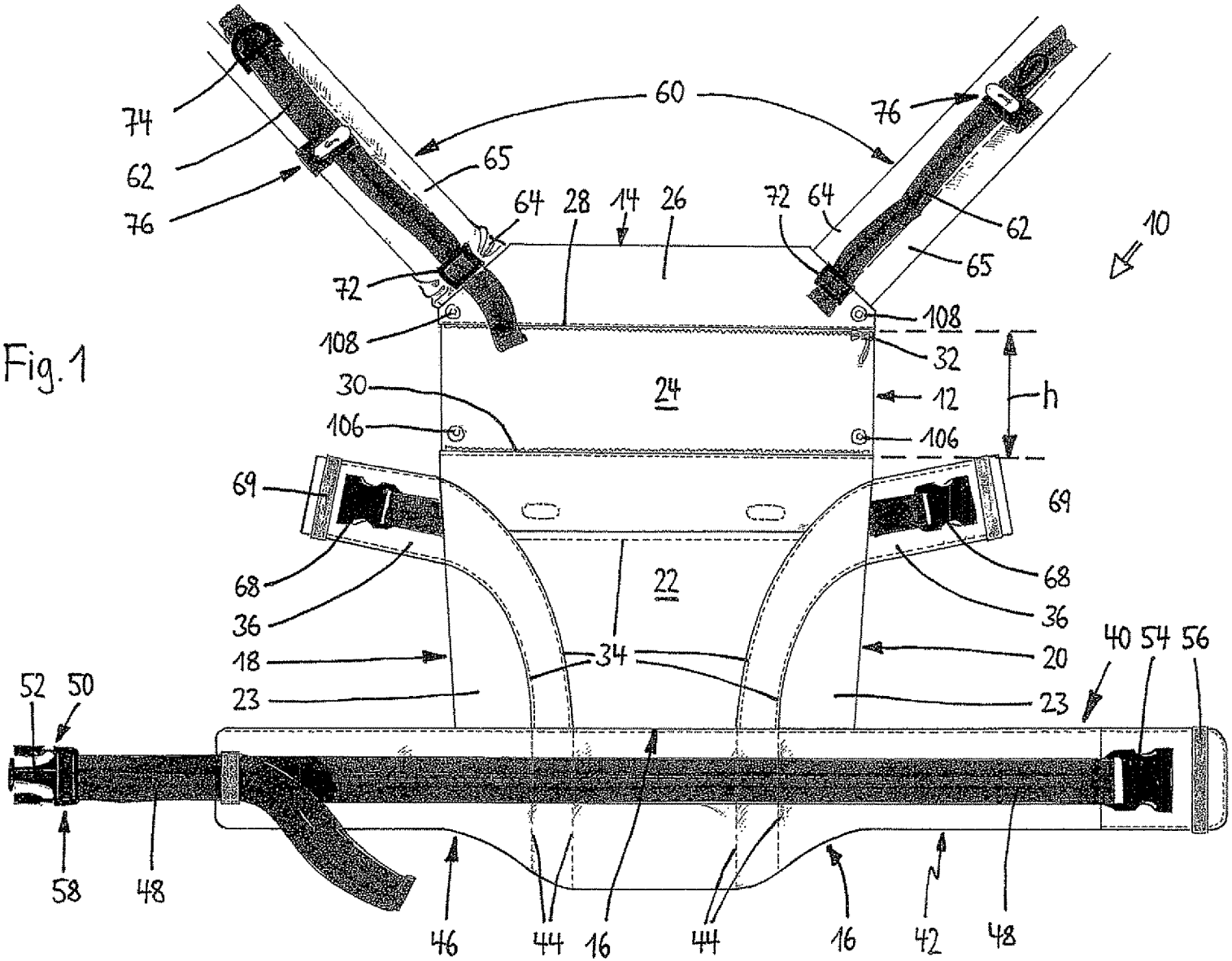
FIG. 1 shows a rear view of a first embodiment of the carrying device according to the invention, in which an extension element is in the position in which it extends the receiving body of the carrying device in the vertical direction.

FIG. 1 is a rear view of a first embodiment of a carrying device according to the invention which is referred to in general by the reference number 10. The carrying device 10 comprises a receiving system with a receiving body 12 in which at least one area of the rear side of a small child can be received.

The receiving body 12 is produced from a stable, one or two layer fabric or fabric-like, moldable and slightly elastic material and substantially has a rectangular or trapezoidal shape with an upper edge 14, a lower edge 16 and two mutually opposite side edges 18 and 20. In the present embodiment, said receiving body comprises three sections formed as a single piece with one another and arranged one above another, namely a main section 22, an extension section 24 arranged above the main section 22, and an end section 26 arranged thereabove.

Figure 3:
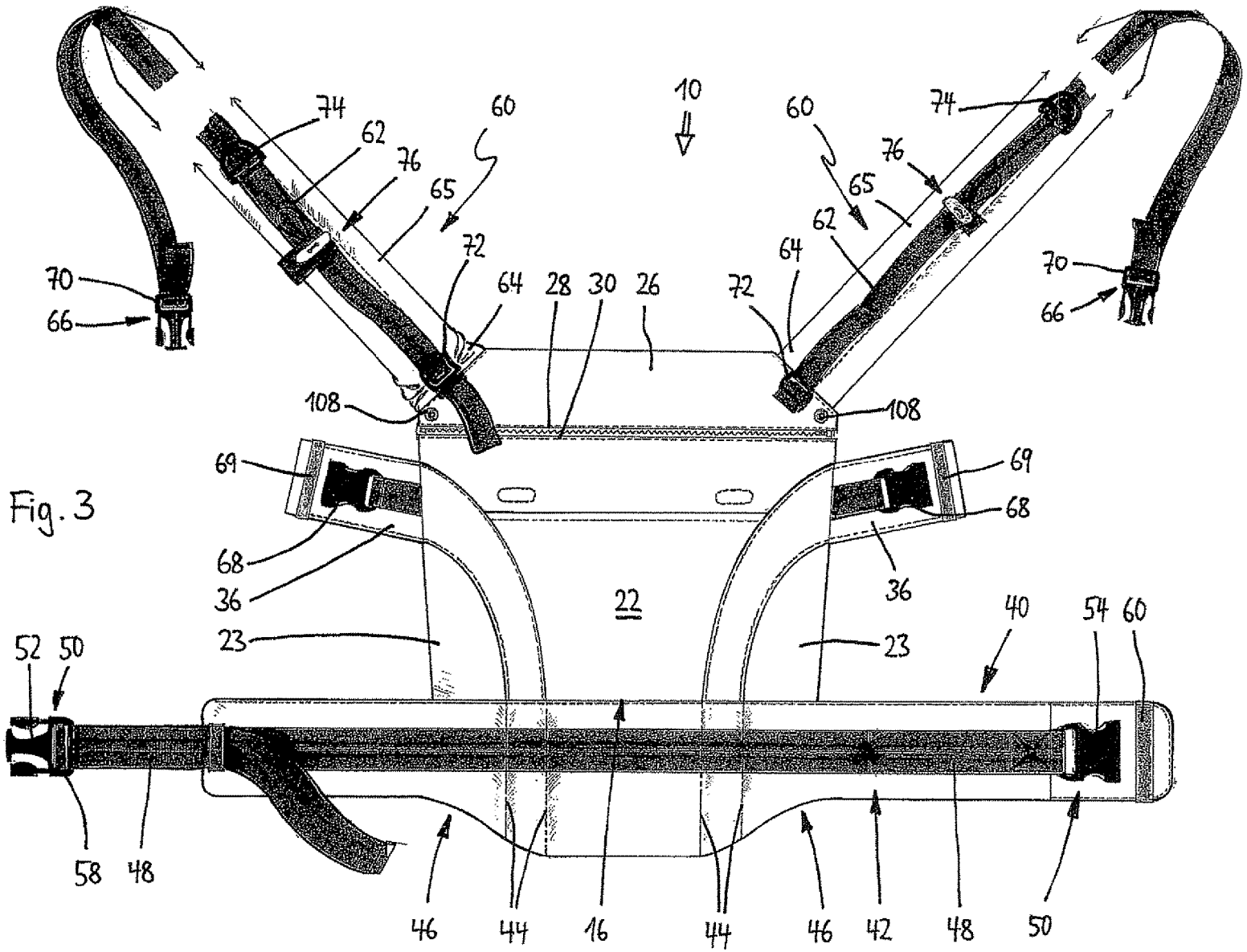
FIG. 3 shows a rear view of the carrying device illustrated in FIGS. 1 and 2, wherein the extension element is in the position in which it does not extend the receiving body in the vertical direction.

Respective zipper strips 28, 30 which are provided with teeth are arranged on the linear transition regions between the main section 22 and the extension section 24 and between the extension section 24 and the end section 26, wherein the zipper strips 28 and 30 can be positioned next to each other and can be fastened to each other by interaction with a zipper slide 32, as shown in FIG. 3. However, in the state illustrated in FIG. 1 of the carrying device 10, the zipper strips 28 and 30 are spaced apart from each other such that the extension section 24 increases the overall height of the receiving body 12 by the height h of the extension section 24. A plurality of tucks 34 are provided in the upper region of the central section 22, which substantially serves to receive the small child's bottom area, the tucks providing the main section 22 with a slight hollow shape such that the child sits anatomically correctly as in a preshaped pocket and the thighs are easily drawn up to his body. In order to increase the comfort, the receiving body 12 can additionally be padded in regions 23, in particular so that the child's thighs do not receive any pressure points.

Figure 7:
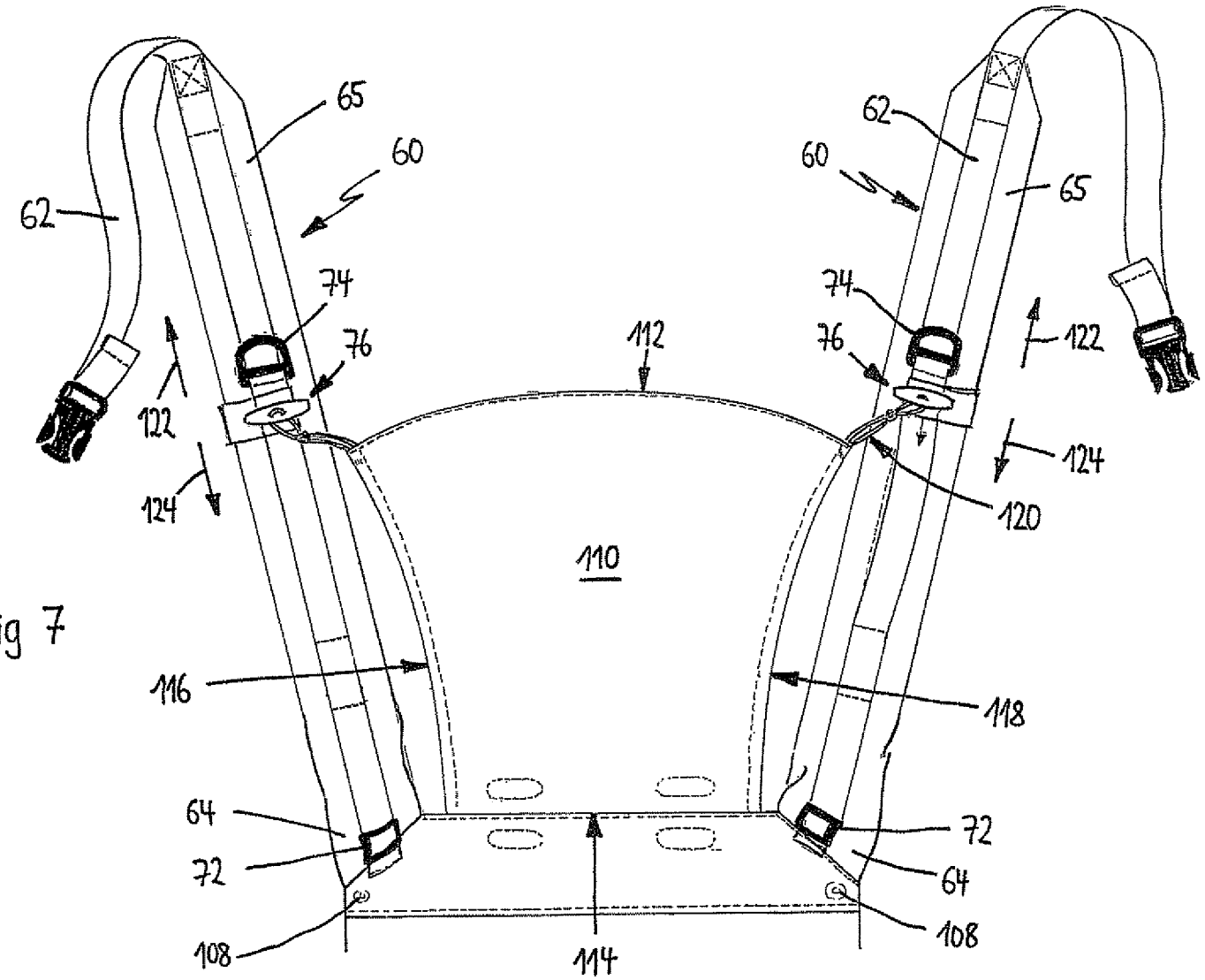
FIG. 7 shows a rear view of a further embodiment of a carrying device according to the invention.

An elongate, underpadded clip 36, to which the closure elements 68 of the shoulder straps 62 are fastened, protrudes on each side of the receiving body 12. A pocket (not illustrated in FIG. 1) which is accessible from the upper edge 14 of the receiving body 12 is incorporated into the end section of the receiving body 12. Said pocket serves for the stowing of a head part 110 which is illustrated in FIG. 7.

A hip strap device 40 is fastened substantially centrally to the lower edge 16 of the receiving body 12. The hip strap device 40 comprises a base body 42 which is produced from an elongate, rectangular fabric material and is padded at points with foam, neoprene or a similarly stabilizing material, thus ensuring a good dissipation of weight to the wearer's hips and high wearing comfort.

In order to ensure the mobility of the base body 42, the latter is divided by vertical tucks 44 into a plurality of parts. Two wing-like cutouts 46 on the lower border of the base body 42 improve the anatomical fitting shape and, when the device is being worn in front of the stomach, form corresponding bulges for the wearer's thighs if the wearer wants to kneel or sit down.

Furthermore, the hip strap device 40 comprises a hip strap 48 which extends along the base body 42 and is held thereon. The hip strap 48 can be fastened releasably to a person's hips with the aid of a closure element 50. The closure element 50 comprises two closure members 52 and 54 which are fastened to the free ends of the hip strap 48 and can be brought into engagement with each other in the manner of a plug-in connection. In order to prevent immediate release of the hip strap 48 after the opening of the closure element 50, the hip strap device 40 comprises a safety device 56 in the form of a loop through which the closure member 54 is guided during the closure of the closure element 50 before said closure member is brought into engagement with the closure member 52. If the closure members 52 and 54 are subsequently separated from each other, the closure member 54 remains attached to the safety device 56, which is designed in the manner of a loop, such that the fastening, which is realized by the hip strap device 40, to the wearer's hips is not immediately released. This is to prevent the small child received in the receiving body 12 of the carrying device 10 from being able to drop out when the hip strap device 40 is opened.

Irrespective of all of this, the hip strap device 40 has an adjustment device 58 which, in the present case, is designed as a single piece with the closure member 52 of the closure element 50. With the aid of the adjustment device, the length of the hip strap 48 can be changed in a known manner in order to adapt said length to the body build and the height of the wearer.

The carrying device 10 furthermore comprises a shoulder strap device 60 with shoulder straps 62 which are fastened laterally to the upper edge 14 of the end section 26 of the receiving body 12. Furthermore, two shoulder pad sections 65 are fastened laterally to the upper edge 14, said shoulder pad sections extending under the shoulder straps 62 and ensuring a comfortable fit of the carrying device 10 on the wearer's shoulders.

As can readily be seen in particular in FIG. 3, closure members 66 are arranged at the end of each shoulder strap 62. These closure members 66 can be brought releasably into engagement with corresponding closure members 68 which are fastened to clips 36 protruding outward laterally from the main section 22 of the receiving body 12. If the closure members 66 and 68 are brought into engagement with each other, the shoulder straps 62 each form the shape of a loop which can be pulled over an arm and can be arranged resting on the wearer's shoulder.

Like the hip strap 48, the shoulder strap device 60 is also provided with safety devices 69 in order to prevent immediate opening of the loops after the opening of the closure elements 66, 68. Each safety device 69 is in the form of a loop through which the closure member 66 has to be guided during the closing of the closure before said closure member is brought into engagement with the closure member 68. If the closure members 66 and 68 are subsequently separated from each other, the closure member 66 remains attached to the safety device 69, which is designed in the manner of a loop, and therefore the shoulder strap loops cannot open immediately. This prevents the baby or the small child from being able to inadvertently drop out when the carrying device 12 is removed.

A first adjustment device 70, with the aid of which the length of each shoulder strap 62 can be individually changed, is designed as a single part with each closure member 66. A further adjustment device 72 is provided at the other end of each shoulder strap 62. Said adjustment device 72 not only brings about an adjustment of the shoulder strap length 62; it also tightens together the preferably unpadded strap section 64 located therebelow when, with the aid of said adjustment device, the length of the shoulder strap 62 is shortened, as indicated on the left side in FIG. 1. Not only is the strap length thereby adapted to the wearer's body build, but also the position of the padded section 65 will always be optimally selected.

Furthermore, a respective D-shaped ring 74, to which, for example, a pacifier chain or the like can be fastened, is held on the shoulder straps 62. Finally, a receiving element 46 is provided on each shoulder strap 62, the receiving element being arranged movably along the direction of extent of the shoulder strap and being optionally fixable at different positions on the respective shoulder strap 62. The receiving elements 76 serve to receive fastening elements of a head part, which will be explained in more detail with reference to FIGS. 7 and 8.

The previously described construction of the shoulder strap device 60 permits a small child to be carried in various positions. The following variants are possible here:

i. The receiving body 12 is arranged on the wearer's stomach, the shoulder straps 62 crossing over on the back;
ii. The receiving body 12 is arranged on the wearer's stomach, the shoulder straps 62 being shaped to form loops and not crossing over;
iii. The receiving body 12 is arranged on the wearer's back, the shoulder straps 62 being shaped to form loops and not crossing over;
iv. The receiving body 12 is arranged on the wearer's back, the shoulder straps 62 crossing over on the chest; and
v. The receiving body 12 is arranged laterally on the wearer's hips, one shoulder strap 62 being closed obliquely over the shoulder and the other shoulder strap 62 being closed vertically on the back.

Figure 2:
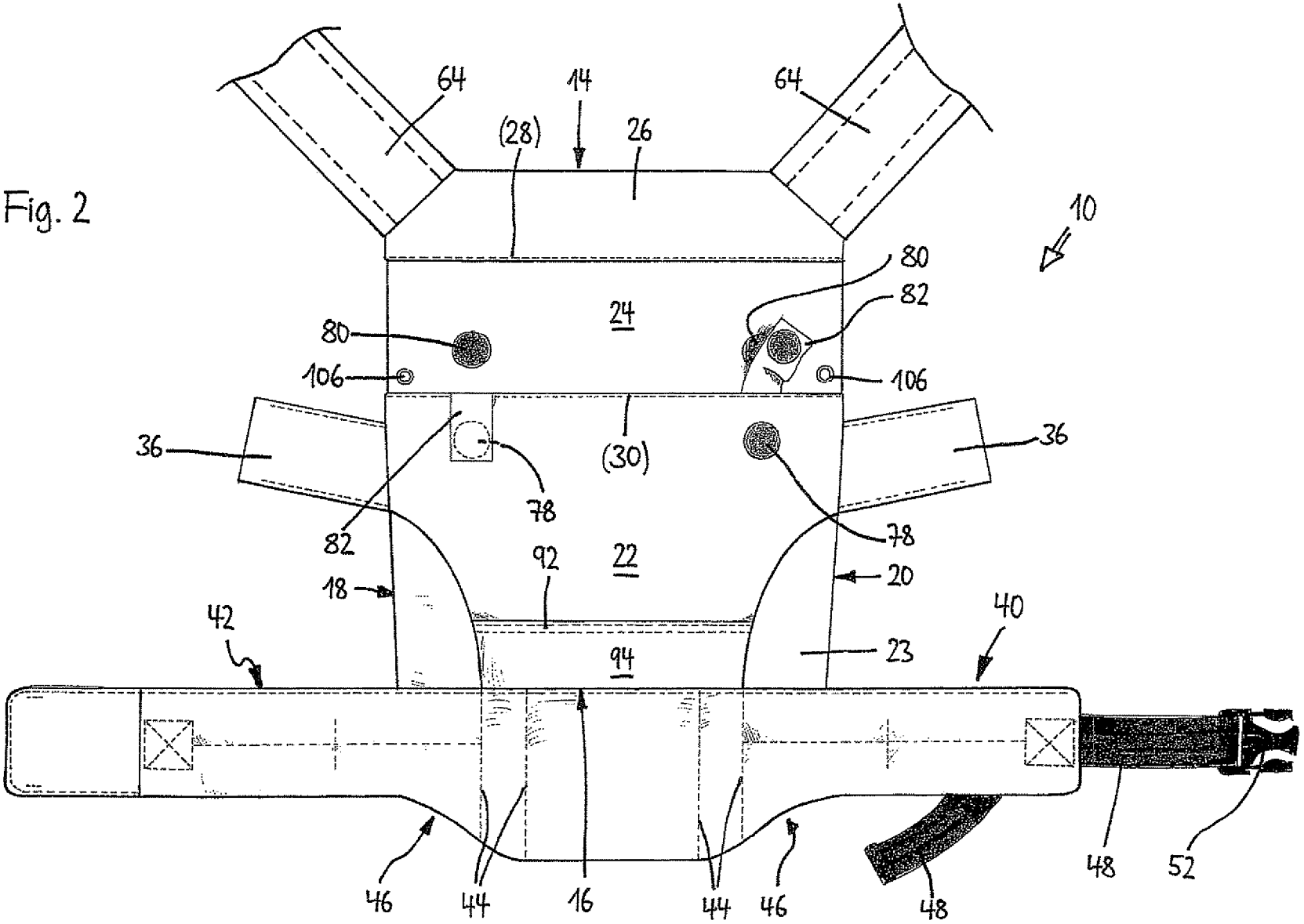
FIG. 2 shows a front view of the carrying device illustrated in FIG. 1.
Figure 4:
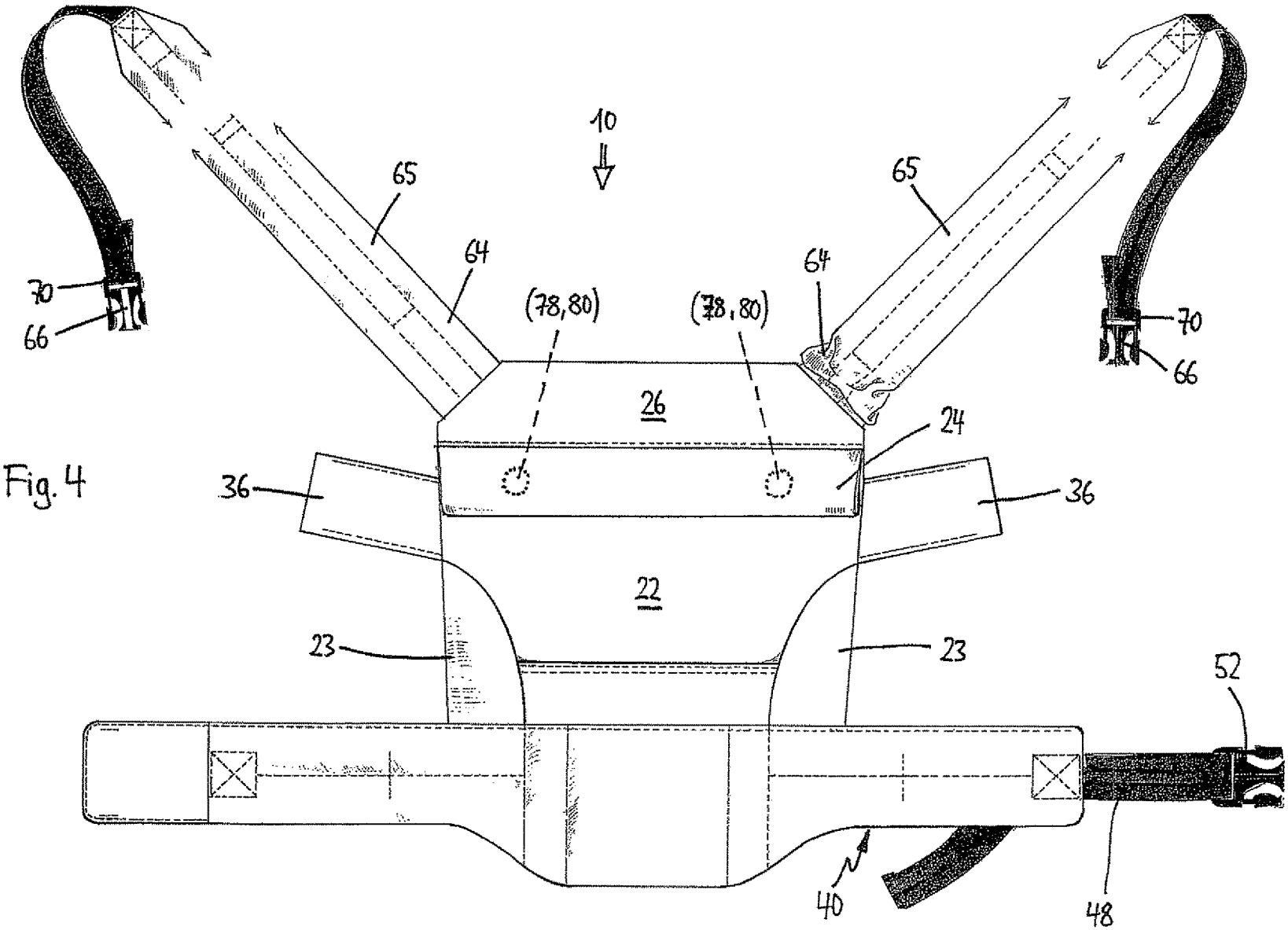
FIG. 4 shows a front view of the carrying device illustrated in FIG. 3.

FIG. 2 shows a front view of the carrying device 10 which is illustrated in FIG. 1. The surface formed in this view by the main section 22, the extension section 24 and the end section 26 of the receiving body 12 forms the receiving surface for an area of the rear side of the small child. The receiving body 12 comprises two touch and close fasteners, wherein, in the present case, the barb surfaces 78 of the touch and close fasteners are provided in the upper region of the main section 22 and the loop surfaces 80 of the touch and close fasteners are provided in the lower region of the extension section 24. If the zipper strips 28 and 30 which are illustrated in FIG. 1 are brought into engagement with each other by actuation of the zipper slide 32, the extension section 24 can be folded up downward in such a manner that the barb surfaces 78 are brought into engagement with the corresponding loop surfaces 80 such that the extension section 24 is held, folded in the downward direction, on the inner side of the main section 22, as illustrated in FIG. 4. The extension section 24 of the receiving body 12 can thereby be stowed in the position in which the extension section does not increase the height of the receiving body 12. By folding the extension section 24 in the downward direction, dirt is prevented from accumulating in the fold of the extension section 24.

In order, in the unfolded state of the extension section 24 of the receiving body 12, which is illustrated in FIG. 2, to cover the barb surfaces 78 of the touch and close fasteners, which barb surfaces are unpleasant for the small child, strip-shaped covering elements 82 are provided which, as shown on the left in FIG. 2, can be arranged over the barb surfaces 78 of the touch and close fasteners. When the extension section 24 is folded up, the covering elements 82 can be folded to the side, as indicated on the right in FIG. 2, and therefore the barb surfaces 78 can be brought into engagement with the loop surfaces 80.

FIGS. 3 and 4 show the carrying device 10 illustrated in FIGS. 1 and 2 in the state in which the extension section 24 is folded up. In this state, the zipper strips 28 and 30 are in engagement with each other, as shown in FIG. 3, and the extension section 24 is folded inward in the downward direction forming a loop, wherein the barb surfaces 78 and the loop surfaces 80 of the touch and close fasteners are in engagement with one another, as can be seen in FIG. 4.

Figures 5, 6:
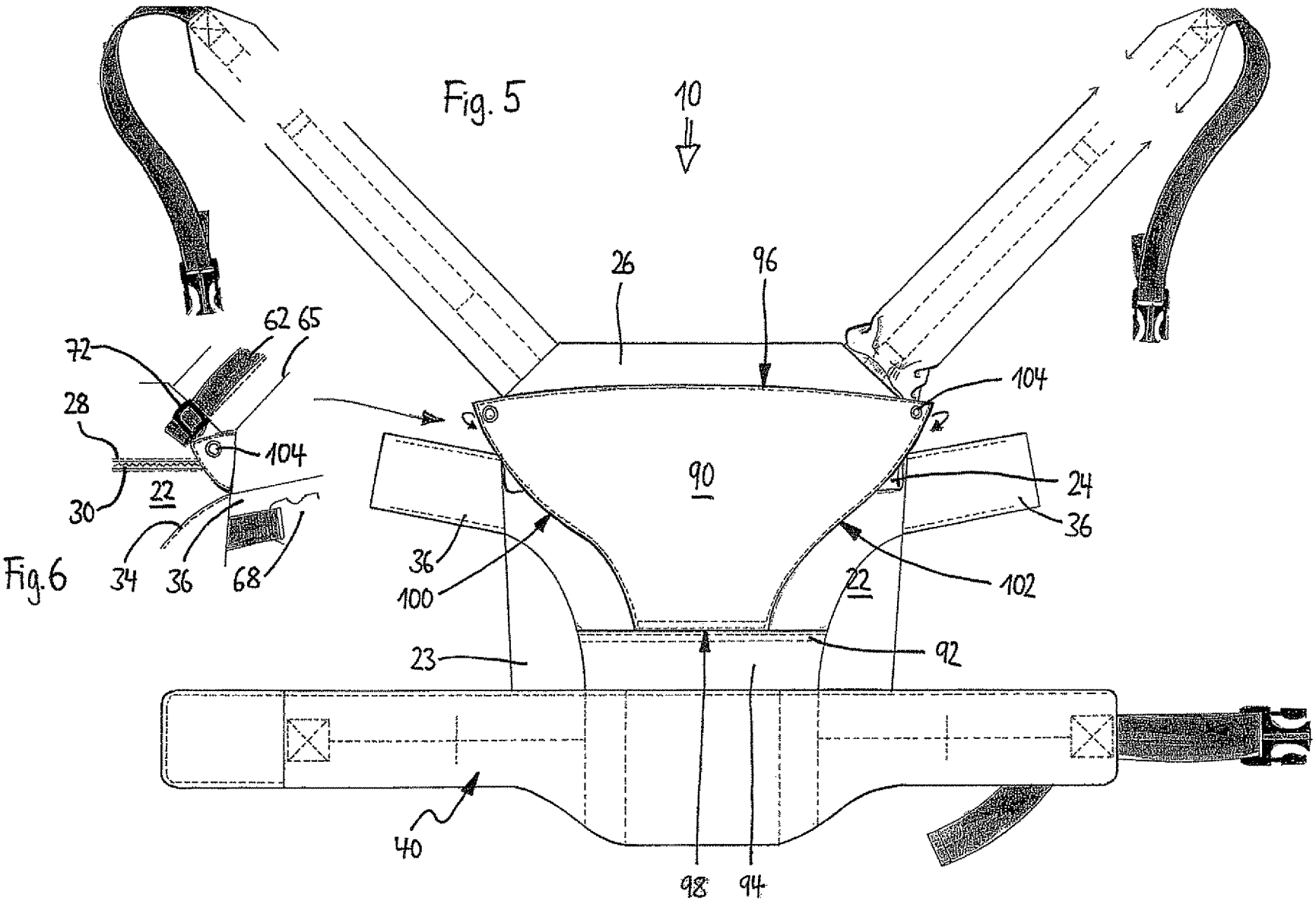
FIG. 5 shows a front view of the carrying device illustrated in FIGS. 1 to 4, with the seat reduction device unfolded.
FIG. 6 shows a rear view of the carrying device illustrated in FIG. 5, the rear view showing a subregion of said carrying device.

FIG. 5 shows a front view of the carrying device 10 illustrated in FIGS. 1 to 4 in a state in which a seat reduction device 90, which in the previous illustrations was accommodated folded up in a pocket 94 provided with a strip-shaped touch and close fastener 92, a zipper or the like, is unfolded. The seat reduction device 90 is produced from a fabric material and has a substantially trapezoidal cut with an upper edge 96, a lower edge 98 and two curved side edges 100 and 102. The lower edge 98 is fastened fixedly to the main section 22 of the receiving body 12 by means of a seam, and therefore the seat reduction device 90 is designed as a single part with the receiving body 12. The seat reduction device 90 is pulled up between the legs of the small child until it covers the stomach and lower body of the child. It is subsequently folded at the upper, free corners thereof laterally around the receiving body 12 and fixed to the rear side of same. For this purpose, a respective snap fastener member 104 is provided at the upper, free corners of the seat reduction device 90, which snap fastener member can be brought into engagement with one of the snap fastener members 106 or 108 which are correspondingly arranged on the rear side of the extension section 24 and of the end section 26 of the receiving body 12, as can be seen in the detailed rear view according to FIG. 6. The snap fastener members 104 are brought into engagement with the snap fastener members 106 when the extension section 24 is in the position in which the effective height of the receiving body 12 is increased by said extension section by the height h thereof, and the snap fastener members 104 are brought into engagement with the snap fastener members 108 when the extension section 24 is in the folded up state thereof, as illustrated in FIGS. 3, 4 and 5.

Alternatively, the baby may, of course, also be inserted into the seat reduction device 90 which is already fastened to the rear side of the receiving body 12.

In the seat reduction device 90, a baby which is still relatively small is in particular held higher in the receiving body 12, with the baby's legs being optimally spread. They may protrude laterally out of the receiving body.

The variants mentioned below can be realized with the aid of the seat reduction device 90 and the extension section 24 of the receiving body 12:

i. Zipper strips 30 and 32 in engagement and seat reduction device 90 in use (for very small children and babies);
ii. Zipper strips 30 and 32 not in engagement and seat reduction device 90 in use (for very small, but long small children);
iii. Zipper strips 30 and 32 in engagement and seat reduction device 90 not in use (for small children with long thighs or babies from 3 months) and
iv. Zipper strips 30 and 32 not in engagement and seat reduction device 90 not in use (for tall small children of up to, for example, approximately 20 kg).

FIG. 7 shows a front view of the carrying device 10 in a state in which a head part 110 is in an unfolded position. The head part 110 is produced from a cloth-like material and has a substantially rectangular shape with an upper edge 112, a lower edge 114 and two mutually opposite side edges 116 and 118. The lower edge 114 of the head part 110 is connected fixedly to the upper edge 14 of the receiving body 12 with the aid of a seam. Fastening elements 120 in the form of elastic cords are sewn into the side edges 116 and 118 of the head part 110, the ends of which fastening elements protrude in each case over the upper edge 112 and form a loop. The loops are placed around T-shaped projections of the receiving elements 76 which are positioned on the shoulder straps 62. If the receiving elements 76 are moved together with the fastening elements 120, which are arranged thereon, of the head part 110 in the direction of the arrows 122, the head part 110 is correspondingly tensioned. By contrast, if the receiving elements 76 are moved in the direction of the arrows 124, the head part 110 is relaxed.

Figure 8:
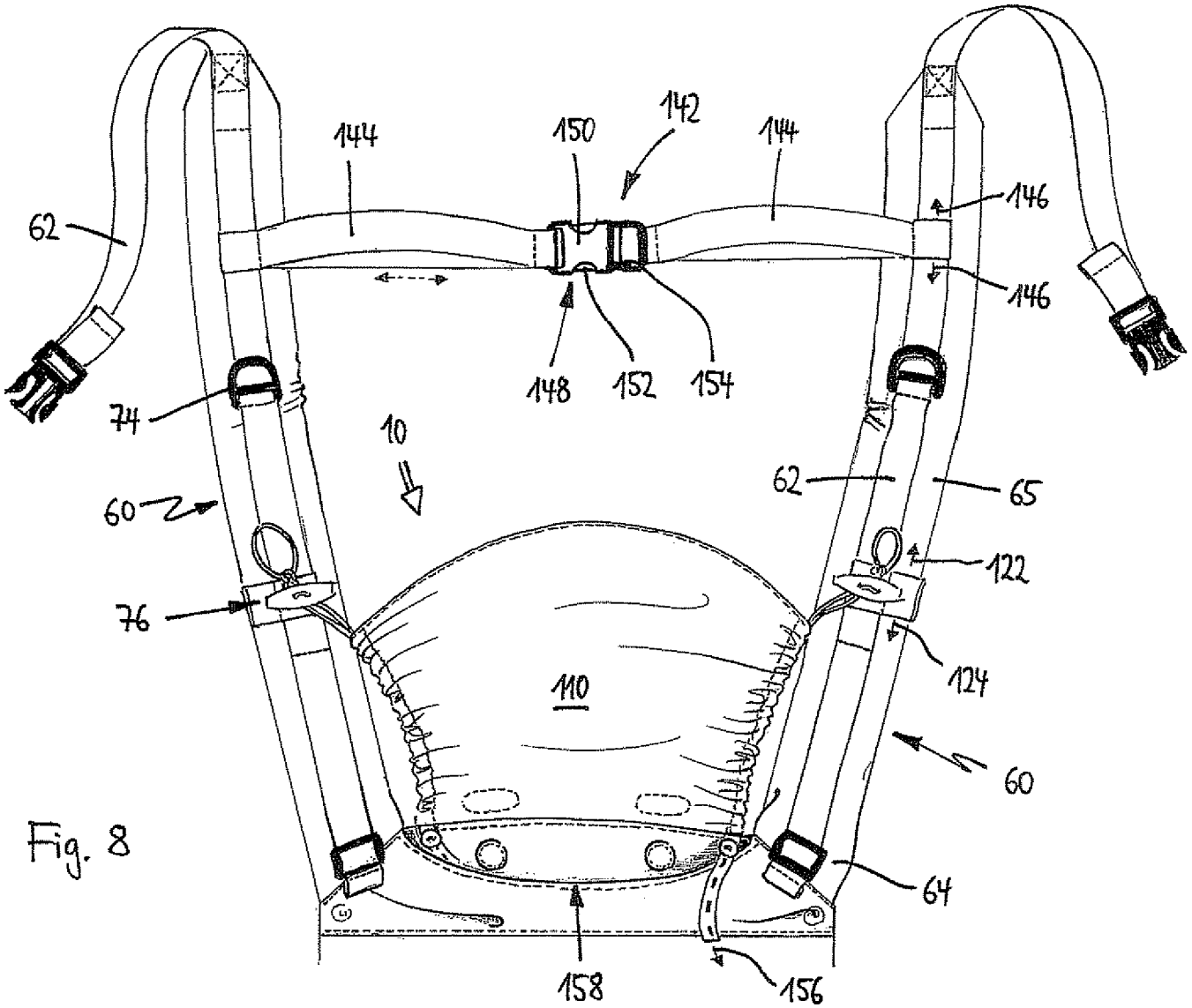
FIG. 8 shows a rear view of another embodiment of a carrying device according to the invention.

FIG. 8 shows a front view of a further embodiment of a carrying device 140, the construction of which substantially corresponds to parts of the carrying device 10 illustrated in FIGS. 1 to 7. In contrast to the carrying device 10, the carrying device 140 additionally comprises a chest strap device 142 with a chest strap 144 which is fastened at the free ends thereof at a corresponding height to the shoulder straps 62, the chest strap 144 being displaceable in the direction of extent of the shoulder straps 62, which is indicated by the arrows 146 in FIG. 8.

For the releasable fastening of the chest strap 144, the latter comprises a closure element 148 with closure members 150 and 152 which can be plugged separately one into the other. An adjustment device 154 is designed as a single part with the closure member 152 and can be used to adjust the chest strap 144 in respect of the length thereof in a known manner.

Furthermore, the carrying device 140 comprises the head part 110 of the embodiment, illustrated in FIGS. 1 to 7, of the carrying device 10 according to the invention, only said head part is shown in the tightened together state. In order to tighten together the head part 110, the receiving elements are moved downward in the direction of the arrows 124, and the elastic cords, which form the fastening elements 120, are pulled downward, as shown by the arrow 156.

The head part 110 which is illustrated in FIGS. 7 and 8 serves in the tightened together state primarily as a headrest for sleeping children, the neck muscles of whom are relaxed in this state such that the head tends to tilt away to the rear. By contrast, in the tensioned state, the head part 110 serves as a sunshield.

The head part 110 can be rolled up or folded and stowed in a pocket 158 which is formed in the end section 26 of the receiving body 12.

Furthermore, the head part 110 can also be designed in the manner of a hood, but this is not illustrated in the figures.

The carrying device according to the invention ensures an orthopedically correct manner of support which is adapted both to the needs of the small child and also to those of the wearer. By means of the different adjustment variants which are made possible by the extension element for extending the receiving body and the seat reduction device, small children of very different heights, in particular even small children immediately after birth, can be received in the carrying device according to the invention. The carrying device has a very low weight and can be folded up compactly.

The invention is not restricted to one of the above-described embodiments, but rather can be modified in diverse ways.

All of the features and advantages emerging from the claims, the description and the drawing, including structural details, three-dimensional arrangements and method steps, may be essential to the invention both on their own and in a great variety of combinations.

LIST OF REFERENCE NUMBERS

10 Carrying device
12 Receiving body
14 Upper edge
16 Lower edge
18 Side edge
20 Side edge
22 Main section
24 Extension section
26 End section
28 Zipper strip
30 Zipper strip
32 Zipper slide
34 Tuck
36 Clip
40 Hip strap device
42 Base body
44 Tuck
46 Cutouts
48 Hip strap
50 Closure element
52 Closure member
54 Closure member
56 Safety device
58 Adjustment device
60 Shoulder strap device
62 Shoulder straps
64 Strap section
65 Padded section
66 Closure member
68 Closure member
69 Safety device
70 Adjustment device
72 Adjustment device
74 Ring
76 Receiving elements
78 Barb surfaces
80 Loop surfaces
82 Covering elements
90 Seat reduction device
92 Touch and close fastener
94 Pocket
96 Upper edge
98 Lower edge
100 Side edge
102 Side edge
104 Snap fastener members
106 Snap fastener members
108 Snap fastener members
110 Head part
112 Upper edge
114 Lower edge
116 Side edge
118 Side edge
120 Fastening elements
122 Arrows
124 Arrows
140 Carrying device
142 Chest strap device
144 Chest strap
146 Arrows
148 Closure element
150 Closure member
152 Closure member
154 Adjustment device
156 Arrow
158 Pocket

The invention claimed is:

1. A carrying device (10) for receiving a baby or small child in such a manner that at least a region of the baby's or small child's back can be received and/or can be supported therein, the carrying device comprising:

a holding harness system (40, 60) for fastening a receiving body (12) to a person, comprising a hip strap (40) and a pair of shoulder straps (60), each shoulder strap having a free end, the receiving body having a longitudinal length and positioned with respect to the holding harness system to contact and support at least a region of a back of the baby or small child;

wherein the receiving body (12) further comprises:

a main body portion having a lower edge;

an end portion, the end portion having an upper end, the upper end including opposing edges, which are angled with respect to a longitudinal axis of the receiving body;

an extension element positionable between the main body portion and the end portion, wherein the extension element, the main body portion, and the end portion are of a unitary one piece construction or a multiple piece construction with the multiple pieces stitched together, and means for changing the longitudinal length of the receiving body using the extension element to be able to accommodate both the baby and the small child, the extension element is positioned between the main body portion and the end portion so as to contact the region of the baby's or small child's back, and further wherein the hip strap (40) is fastened along a central portion thereof to a lower edge of the main body and each shoulder strap (60) is fastened to each respective opposing edge of the upper end of the end portion.

2. The carrying device as claimed in claim 1, wherein the extension element (24) is designed in one piece with the receiving body (12).

3. The carrying device as claimed in claim 1, wherein the extension element (24) can be adjusted between at least two positions, a first position, in which the height of the receiving body (12) is not increased, and a second position, in which the height of the receiving body (12) is increased.

4. The carrying device as claimed in claim 3, wherein the extension element (24) can be folded from the first position into the second position and vice versa.

5. The carrying device as claimed in claim 3, wherein the extension element (24) can be rolled up and unrolled from the first position into the second position.

6. The carrying device as claimed in claim 1, further comprising a seat reduction device (90), the seat reduction device positionable on the receiving body (12) in such a manner that a baby or a small child is received in an elevated position in the receiving body (12).

7. The carrying device as claimed in claim 6, characterized in that the seat reduction device (90) can be adjusted between at least two positions, a first position, in which the seat reduction device (90) reduces the height of the child's seat in the receiving body (12), and a second position, in which the seat reduction device (90) does not reduce the height of a child's seat in the receiving body (12).

8. The carrying device as claimed in claim 1, further comprising a head part (110).

9. The carrying device as claimed in claim 8, wherein the head part (110) is connected releasably or fixedly to the receiving body (12).

10. The carrying device as claimed in claim 8, wherein the head part (110) has fastening elements (120) which can be positioned on the carrying harness system.

11. The carrying device as claimed in claim 10, wherein the fastening elements (120) are designed in such a manner that they can tension or tighten the head part (110).

12. The carrying device as claimed in claim 10, wherein receiving elements (76) for receiving the fastening elements (120) are arranged on the holding harness system.

13. The carrying device as claimed in claim 12, wherein the receiving elements (76) are arranged movably on the carrying harness system, said receiving elements being designed in such a manner that they can optionally be fixed at different positions on the holding harness system.

14. The carrying device as claimed in claim 1, wherein the means for changing the longitudinal length of the receiving body using the extension element does not change dimensions in a pocket of the main body portion that receives the seat of a small child or baby.

* * * * *